US005088348A

United States Patent [19]

Hiramuki

[11] Patent Number: 5,088,348

[45] Date of Patent: Feb. 18, 1992

[54] EXHAUST BRAKE CONTROL OF MOTOR VEHICLE WITH AUTOMATIC TRANSMISSION

[75] Inventor: Michiaki Hiramuki, Shizuoka, Japan

[73] Assignee: Jatco Corporation, Japan

[21] Appl. No.: 669,889

[22] Filed: Mar. 14, 1991

[30] Foreign Application Priority Data

Sep. 14, 1988 [JP] Japan ..... 63-228807

[51] Int. Cl.[5] ..... F02D 9/06

[52] U.S. Cl. ..... 74/859; 123/322

[58] Field of Search ..... 74/859, 860, 878; 123/321, 322

[56] References Cited

U.S. PATENT DOCUMENTS

| | | | |
|---|---|---|---|
| 2,393,579 | 1/1946 | Weiss et al. | 123/322 |
| 3,710,908 | 1/1973 | Muir | 74/878 X |
| 4,188,933 | 2/1980 | Iizuka | 123/322 X |
| 4,680,992 | 7/1987 | Hayasaki et al. | 74/869 |
| 4,742,806 | 5/1988 | Tart, Jr. et al. | 123/322 |
| 4,966,110 | 10/1990 | Seki et al. | 123/321 X |
| 4,996,893 | 3/1991 | Nakamura et al. | 74/866 |

FOREIGN PATENT DOCUMENTS 62-204042 9/1987 Japan .

OTHER PUBLICATIONS

Service Manual "Nissan Full-Range Electronically Controlled Automatic Transmission E-AT, RE4R01A Type", (A2671C07) (no date).

"Automotive Engineer's Hand Book", pp. 6–46 and 6–47 (no date).

*Primary Examiner*—Dirk Wright

*Attorney, Agent, or Firm*—Ronald P. Kananen

[57] ABSTRACT

An exhaust brake control ensures a shock less shift after the automatic transmission has been conditioned for engine brake running state by rendering an exhaust brake system inoperable temporarily for a predetermined period of time when the shift is in progress in the automatic transmission.

7 Claims, 3 Drawing Sheets

EXHAUST BRAKE CONTROL OF MOTOR VEHICLE WITH AUTOMATIC TRANSMISSION

BACKGROUND OF THE INVENTION

The present invention relates to a motor vehicle including an automatic transmission and an engine with an exhaust brake system, and more particularly to a control of such an exhaust brake system.

A known automatic transmission has a manual selector lever having a D range and a 2 range. When the 2 range is selected by the manual selector lever, the automatic transmission is conditioned in engine brake running state where a direct motion connection is established between the transmission input and output shafts. If, under this condition, an exhaust brake switch is turned on, an exhaust brake system becomes in operation to cause activation of exhaust brake. With the automatic transmission in the engine brake running state and the exhaust brake activated, if the vehicle speed drops down to a vehicle speed value at which the automatic transmission effects a downshift, a great shift shock cannot be avoided. The present invention aims at alleviating this problem.

SUMMARY OF THE INVENTION

The present invention ensures a shock less shift after the automatic transmission has been conditioned for engine brake running state by rendering an exhaust brake system inoperable temporarily for a predetermined period of time when the shift is in progress in the automatic transmission.

According to the present invention, a motor vehicle having an automatic transmission and an exhaust brake system is provided with:

means for generating a command for engine brake running state; and means for rendering the exhaust brake system inoperable temporarily for a predetermined period of time when a predetermined shift is in progress in the automatic transmission after said command has been generated.

According to one embodiment, the predetermined period of time is variable with the vehicle speed.

According to another aspect of the present invention, there is provided a method of exhaust brake control in a motor vehicle having an engine and an automatic transmission, the automatic transmission having an input shaft and an output shaft and being shiftable to an engine brake running state wherein a direct motion connection is established between the input and output shafts, the motor vehicle also having an exhaust brake system, the method comprising the steps of:

generating a command for the engine brake running state; and rendering the exhaust brake system inoperable temporarily for a predetermined period of time when a predetermined shift is in progress after said command has been generated.

DETAILED DESCRIPTION OF THE INVENTION

Figure 1:
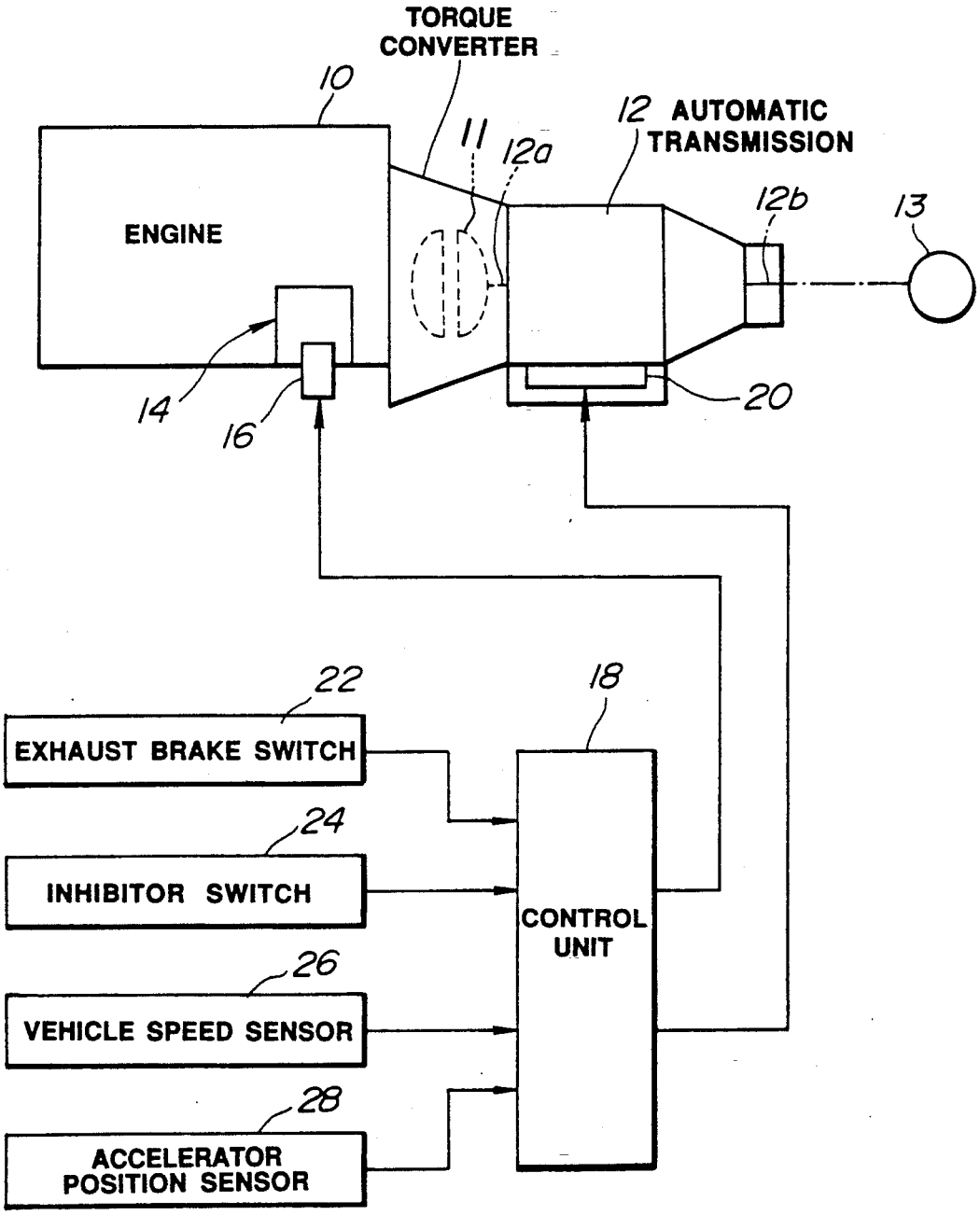
FIG. 1 is a block diagram of a motor vehicle with an exhaust brake system control according to the present invention.

Referring to FIG. 1, a motor vehicle is shown in a block diagram which includes an engine 10 and an automatic transmission 12. The automatic transmission 12 is of the well known RE4R01A type and described in a service manual "NISSAN FULL-RANGE ELECTRONICALLY CONTROLLED AUTOMATIC TRANSMISSION E-AT, RE4R01A TYPE" (A261C07) which was issued by Nissan Motor Co., Ltd. in March, 1987. This publication is hereby incorporated by reference in its entirety. The automatic transmission 12 has an input shaft 12*a*, i.e., a turbine shaft, coupled with a turbine runner of a torque converter 11 whose pump impeller is coupled with the engine 10. An output shaft 12*b* of the automatic transmission is drivingly connected to driving wheels, only one of which being shown at 13.

For increased engine braking, the engine 10 is equipped with an exhaust brake system 14. A typical example of such an exhaust brake system is described on pages 6-46 and 6-47 of "AUTOMOTIVE ENGINNER'S HAND BOOK" published by Society of Automotive Enginners of Japan. Briefly, the exhaust brake system 14 is constituted by a valve arranged for closing the engine exhaust system and a cooperating valve arranged in the engine intake system, means including a solenoid 16 for closing the valve in the exhaust system in response to energization of the solenoid 16, and a manually operable exhaust brake switch 22 disposed near a driver's seat. According to the known control strategy, releasing an accelerator pedal after the exhaust brake switch 22 has been turned on causes energization of the solenoid 16, causing activation of exhaust brake.

The automatic transmission 12 has a hydraulic control valve assembly 20. The control valve assembly 20 has a plurality of solenoids including shift solenoids and a line pressure solenoid. The solenoid 16 of the exhaust brake system 14, and the plurality of solenoids of the control valve assembly 20 are operatively connected to a microcomputer based control unit 18.

Supplied to the control unit 18 are signals generated by the exhaust brake switch 22, a select position detecting switch, i.e., an inhibitor switch 24, a vehicle speed sensor 26, and an accelerator position sensor 28 in the form of a throttle opening degree sensor if the engine has a throttle which opens in degrees. If the engine 10 is a diesel engine which is not provided with a throttle valve, the accelerator position sensor 28 directly measures the position or depressing degree of the accelerator pedal. The selector lever has a N (neutral) range, a D (drive) range, and a 2 range. When the manual selector lever is placed at the 2 range or a power shift switch is set at "POWER" position with the manual selector lever at D range, the automatic transmission 12 is shiftable to an engine brake running state where a direct motion connection is established between the input and output shafts 12*a* and 12*b*. The inhibitor switch 24 detects which one of the plurality of positions the manual selector lever is placed at. The vehicle speed sensor 26 detects a revolution speed of the transmission output shaft 12*b* and thus a vehicle speed of the motor vehicle and generates a vehicle speed indicative signal indicative of the vehicle speed. The accelerator position sensor 28 detects an opening degree of the engine throttle or a depression degree of the accelerator pedal and generates an accelerator depression degree indicative signal indicative of the throttle opening degree or the accelerator depression degree detected.

Operation of this embodiment is as follows:

With the manual selector lever placed at D range, the control unit 18 reads output signals of the vehicle speed sensor 26 and accelerator position sensor 28 and determines a desired or target speed ratio after retrieving a predetermined shift point mapping based on the output signals. In accordance with the output signals of the control unit 18 supplied to the shift solenoids of the control valve assembly 20, the automatic transmission 12 automatically shifts among the first, second, third and fourth speed ratio when the manual selector lever is placed at D range. Let us now assume that the vehicle travels with the third speed ratio established in the automatic transmission 12. If the driver turns on the exhaust brake switch 22 and releases the accelerator pedal, the solenoid 16 of the exhaust brake system 14 is energized. Subsequently, under this condition, if the automatic transmission 12 shifts to the engine brake running state, strong engine brake is accomplished.

In this automatic transmission 12, the engine brake running state is established when an overrunning clutch is engaged. This overrunning clutch is engaged when the vehicle speed drops to a predetermined value with the accelerator pedal released after the power shift switch has been set to a "POWER" position for selecting a power shift pattern with the manual selector lever placed at D range of after the manual selector lever has been moved from D range to 2 range. For further information, reference should be made to pages I-30 to I-32 of the before-mentioned service manual "NISSAN FULL-RANGE ELECTRONICALLY CONTROLLED AUTOMATIC TRANSMISSION E-AT, RE4R01A TYPE" (A261C07). For operation and control of the overrunning clutch of this automatic transmission, reference should be made to U.S. Pat. No. 4,680,992 issued to Hayasaki et al. on Jul. 21, 1987, which is hereby incorporated by reference in its entirety.

As the vehicle speed drops down to a vehicle speed value at which a predetermined shift, for example a 3–2 downshift, is to take place. The control unit 18 determines that a command for the 3–2 downshift is available upon making a judgement that the target speed ratio is the second speed ratio and the actual speed ratio remains the third speed ratio. Then, the control unit 18 renders exhaust brake inoperable by suspending electric current supplied to the solenoid 16 for a predetermined period of time beginning with the command for the 3–2 downshift. The setting of the predetermined period of time is such that the exhaust brake is inoperable while the 3–2 downshift is in progress in the automatic transmission 12. Upon elapse of the predetermined period of time, the control unit 18 allows the exhaust brake to become operable again so that the supply of electric current to the solenoid resumes if the exhaust brake switch 22 is left turned on. Thus, strong engine brake becomes effective again upon completion of the 3–2 downshift.

Figure 2:
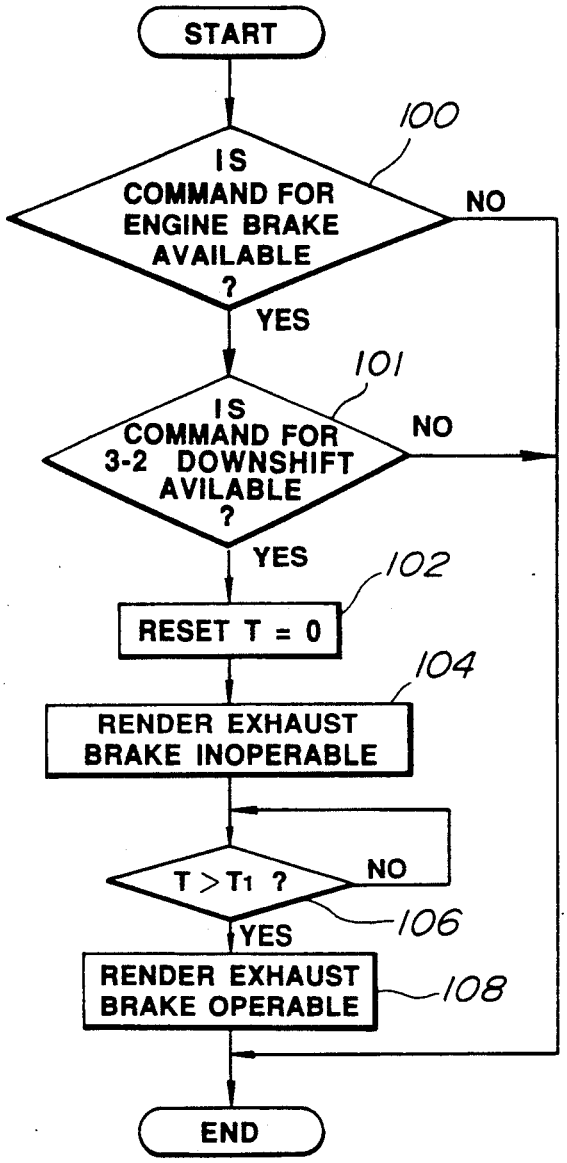
FIG. 2 is a flow diagram of a program stored in a control unit shown in FIG. 1.

The control unit 18 stores a program as illustrated in FIG. 2 and executes the program to perform the operation described above.

Figure 3:
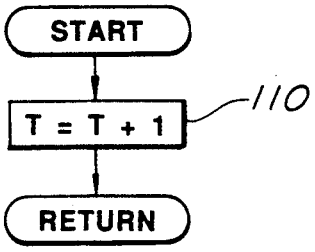
FIG. 3 is a flow diagram of a timer program stored in the control unit.

Referring to FIG. 2, in a step 100, it is determined whether or not there is a command for engine brake running state by checking the output signal of the inhibitor switch 24 or checking the state of the power shift switch. The inquiry in this step 100 results in affirmative when the manual selector lever is set to 2 range or the power shift switch is set to "POWER" position with the manual selector lever set to D range. Otherwise, the inquiry results in negative. If the inquiry of this step 100 results in negative, the execution of this program ends. If it results in affirmative, the program proceeds to a step 101 where it is determined whether or not there is a command o4 requirement for a 3–2 downshift. If the inquiry of this step 101 results in negative, the execution of this program ends. If this inquiry results in affirmative, the program proceeds to a step 102 where a timer T is reset to 0 (zero), and then to a step 104 where the exhaust brake is rendered inoperable even if the exhaust brake switch 22 is turned on by suspending electric current passing through the solenoid 16. After suspending the supply of electric current supplied to the solenoid 16, the program proceeds to a step 106 where it is determined whether or not the timer T is greater than a predetermined period of time $T_1$. The time T is incremented in a step 110 upon executing a program of FIG. 3 upon elapse of a predetermined period of time. Referring back to FIG. 2, the step 106 is repeated as long as the timer T is not greater than $T_1$. Upon elapse of the predetermined period of time $T_1$ after the command for 3–2 downshift has occurred, the timer T becomes greater than $T_1$, and the inquiry of the step 106 results in affirmative. Thus, the program proceeds to a step 108 where the exhaust brake is rendered operable to allow supply of electric current to the solenoid 16 if the exhaust brake switch 22 is left turned on. The setting of the predetermined period of time $T_1$ is such that the 3–2 downshift is completed prior to elapse of this period of time.

It will now be appreciated that since the activation of exhaust brake is suspended while a predetermined shift is in progress in the automatic transmission after a command for engine brake running state has become available, the automatic transmission effects the predetermined shift without substantial shock. Upon completion of the shift, strong engine brake is provided.

Figure 4:
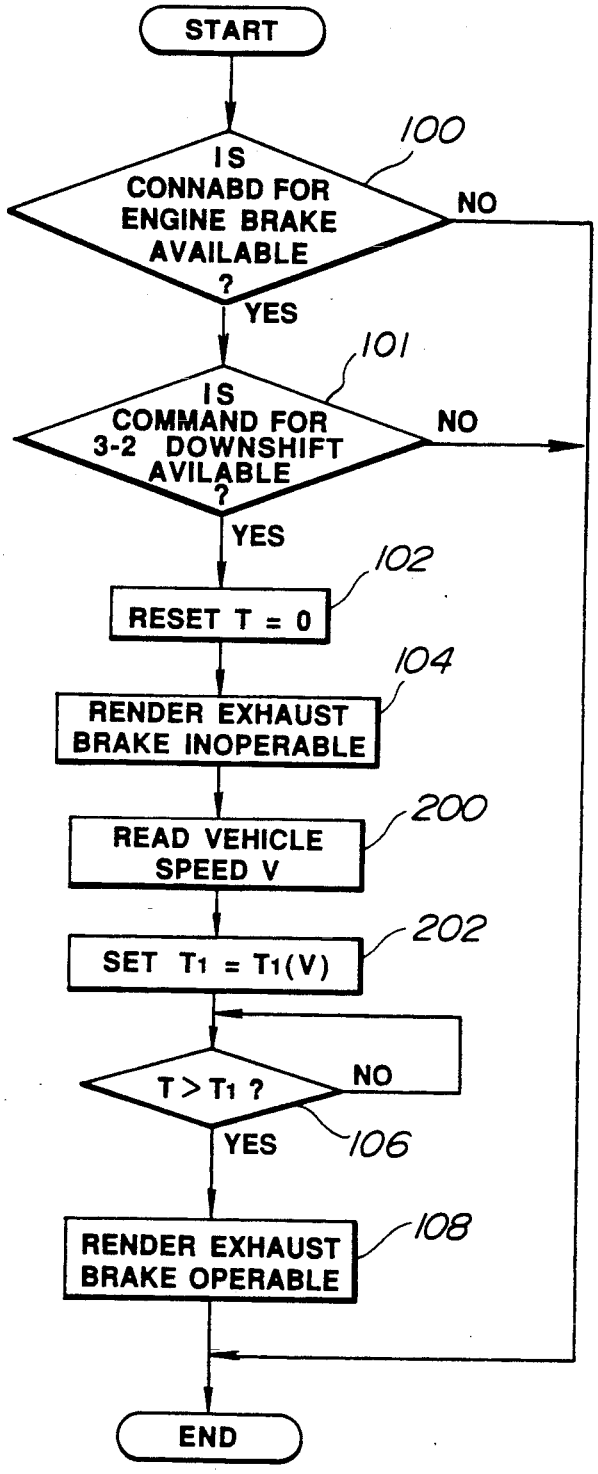
FIG. 4 is a flow diagram of a modification of the program shown in FIG. 2.

Since a period of time required for a shift is dependent on vehicle speed, it is desired to vary the above-mentioned predetermined period of time in proportion to varying vehicle speed. This can be accomplished by slightly modifying the program of FIG. 2. FIG. 4 shows such a modification.

Referring to FIG. 4, this program is different from the program of FIG. 2 in the provision of two steps 200 and 202 between the steps 102 and 106. In the step 200, a reading operation is performed on the output signal of the vehicle speed sensor 26 to store the result as a vehicle speed V. In the subsequent step 202, the predetermined period of time $T_1$ is set as a function of the vehicle speed V stored in the previous step 200.

What is claimed is:

1. In a motor vehicle having an engine and an automatic transmission, the automatic transmission having an input shaft and an output shaft and being shiftable to an engine brake running state wherein a direct motion connection is established between the input and output shafts, the motor vehicle also having an exhaust brake system:

means for generating a command for the engine brake running state; and means for rendering the exhaust brake system inoperable temporarily for a predetermined period of time when a predetermined shift is in progress in the automatic transmission after said command has been generated.

2. A motor vehicle as claimed in claim 1, further comprising:

means for detecting a vehicle speed of the motor vehicle and generating a vehicle speed indicative signal indicative of said vehicle speed detected.

3. A motor vehicle as claimed in claim 2, wherein said predetermined period of time is variable with said vehicle speed indicative signal.

4. In a motor vehicle having an engine and an automatic transmission, the automatic transmission having an input shaft and an output shaft and being shiftable to an engine brake running state wherein a direct motion connection is established between the input and output shafts, the motor vehicle also having an exhaust brake system:

means for generating a command for the engine brake running state;

means for detecting a vehicle speed of the motor vehicle and generating a vehicle speed indicative signal indicative of said vehicle speed detected; and means for setting a predetermined period of time variable with said vehicle speed indicative signal and rendering the exhaust brake system inoperable temporarily for said predetermined period of time when a predetermined shift is in progress in the automatic transmission after said command has been generated.

5. A method of exhaust brake control in a motor vehicle having an engine and an automatic transmission, the automatic transmission having an input shaft and an output shaft and being shiftable to an engine brake running state wherein a direct motion connection is established between the input and output shafts, the motor vehicle also having an exhaust brake system, the method comprising the steps of:

generating a command for the engine brake running state; and rendering the exhaust brake system inoperable temporarily for a predetermined period of time when a predetermined shift is in progress after said command has been generated.

6. A method as claimed in claim 5, wherein said predetermined period of time is variable with a vehicle speed of the motor vehicle.

7. A method of exhaust brake control in a motor vehicle having an engine and an automatic transmission, the automatic transmission having an input shaft and an output shaft and being shiftable to an engine brake running state wherein a direct motion connection is established between the input and output shafts, the motor vehicle also having an exhaust brake system, the method comprising the steps of:

generating a command for the engine brake running state;

determining whether or not there is a command for a predetermined shift in the automatic transmission; and rendering the exhaust brake system inoperable for a predetermined period of time when said predetermined shift is in progress after said command for the engine brake running state has been generated.

* * * * *